US006984181B2

(12) United States Patent
Hettinger et al.

(10) Patent No.: US 6,984,181 B2
(45) Date of Patent: Jan. 10, 2006

(54) MULTIPLE MATERIAL GOLF PUTTER HEAD

(75) Inventors: Ronald K. Hettinger, Oceanside, CA (US); Herbert Reyes, Laguna Niguel, CA (US); Daniel T. Fox, Lakeside, CA (US)

(73) Assignee: Callaway Golf Company, Carlsbad, CA (US)

( * ) Notice: Subject to any disclaimer, the term of this patent is extended or adjusted under 35 U.S.C. 154(b) by 188 days.

(21) Appl. No.: 10/065,203

(22) Filed: Sep. 25, 2002

(65) Prior Publication Data

US 2004/0058743 A1 Mar. 25, 2004

(51) Int. Cl.
*A63B 53/04* (2006.01)
*A63B 53/06* (2006.01)

(52) U.S. Cl. ..... 473/340; 473/345

(58) Field of Classification Search ..... 473/313, 473/340

See application file for complete search history.

(56) References Cited

U.S. PATENT DOCUMENTS

| | | | | |
|---|---|---|---|---|
| 4,532,169 | A * | 7/1985 | Carley | 428/109 |
| 4,664,385 | A * | 5/1987 | Macera | 473/340 |
| 5,482,281 | A * | 1/1996 | Anderson | 473/313 |
| 5,676,606 | A * | 10/1997 | Schaeffer et al. | 473/340 |
| 6,248,025 | B1 * | 6/2001 | Murphy et al. | 473/324 |
| 6,280,349 | B1 * | 8/2001 | Cook | 473/345 |
| 6,342,018 | B1 * | 1/2002 | Mason | 473/252 |
| 6,575,845 | B2 * | 6/2003 | Galloway et al. | 473/329 |
| 6,663,504 | B2 * | 12/2003 | Hocknell et al. | 473/329 |
| 6,688,990 | B2 * | 2/2004 | Sanchez | 473/340 |
| 6,716,110 | B1 * | 4/2004 | Ballow | 473/242 |

* cited by examiner

*Primary Examiner*—Gregory Vidovich
*Assistant Examiner*—Alvin A. Hunter, Jr.
(74) *Attorney, Agent, or Firm*—Michael A. Catania; Elaine H. Lo

(57) ABSTRACT

A putter club head having a metal body and a non-metal crown portion is disclosed herein. The body has a front wall, a sole wall, a ribbon wall and a ledge. The crown portion is preferably composed of a composite material and has a top wall, a side wall and a front wall. The crown portion is preferably attached by a liquid adhesive to the ledge of the body.

1 Claim, 16 Drawing Sheets

MULTIPLE MATERIAL GOLF PUTTER HEAD

CROSS REFERENCE TO RELATED APPLICATIONS

Not Applicable

FEDERAL RESEARCH STATEMENT

Not Applicable

BACKGROUND OF INVENTION

1. Field of the Invention

The present invention relates to a putter club head with a major body composed of a metal material, and a minor body composed of a light-weight material. More specifically, the present invention relates to a putter club head with a major body composed of a metal material and a non-metallic minor body.

2. Description of the Related Art

U.S. Pat. No. 5,482,281 to Anderson discloses a putter head with a lower plate-like member composed of a heavy metal material and an upper shell-like member composed of lightweight material such as wood, aluminum or plastic. A heel weight and a toe weight are mounted on the plate-like member and project upward therefrom.

U.S. Pat. No. 5,842,935 to Nelson discloses a putter head with a metal body and a low-density solid insert that is positioned within a cavity of the body. The insert is preferably composed of a polyurethane material with a Shore D hardness of 65, and the insert forms the striking plate of the putter head.

U.S. Pat. No. 5,951,412 to Rose et al., discloses a putter head with a first element composed of a high density material and a second element composed of a low density material. The first element forms the heel and toe portions as well as the sole of the putter head. The second element forms part of the face of the putter head and is preferably composed of a metal such as aluminum or magnesium.

U.S. Pat. No. 6,146,571 to Vincent, et.al., discloses a method of manufacturing a golf club head wherein the walls are obtained by injecting a material such as plastic over an insert affixed to a meltable core. The core has a melt point lower than that of the injectable plastic material so that once the core is removed, an inner volume is maintained to form the inner cavity. The insert may comprise a resistance element for reinforcing the internal portion of the front wall of the shell upon removal of the core where the reinforcement element is comprised of aluminum with a laterally extending portion comprised of steel.

U.S. Pat. No. 6,149,534 to Peters, et al., discloses a golf club head having upper and lower metal engagement surfaces formed along a single plane interface wherein the metal of the lower surface is heavier and more dense than the metal of the upper surface.

U.S. Pat. Nos. 5,570,886 and 5,547,427 to Rigal, et al., disclose a golf club head of molded thermoplastic having a striking face defined by an impact-resistant metallic sealing element. The sealing element defines a front wall of the striking surface of the club head and extends upward and along the side of the impact surface to form a neck for attachment of the shaft to the club head. The sealing element preferably being between 2.5 and 5 mm in thickness.

U.S. Pat. No. 5,425,538 to Vincent, et al., discloses a hollow golf club head having steel shell and a composite striking surface composed of a number of stacked woven webs of fiber.

U.S. Pat. No. 5,377,986 to Viollaz, et al., discloses a golf club head having a body composed of a series of metal plates and a hitting plate comprised of plastic or composite material wherein the hitting plate is imparted with a forwardly convex shape. Additionally, U.S. Pat. No. 5,310,185 to Viollaz, et al., discloses a hollow golf club head having a body composed of a series of metal plates, a metal support plate being located on the front hitting surface to which a hitting plate comprised of plastic or composite is attached. The metal support plate has a forwardly convex front plate associated with a forwardly convex rear plate of the hitting plate thereby forming a forwardly convex hitting surface.

U.S. Pat. No. 5,106,094 to Desboilles, et al., discloses a golf club head having a metal striking face plate wherein the striking face plate is a separate unit attached to the golf club head with a quantity of filler material in the interior portion of the club head.

U.S. Pat. No. 4,568,088 to Kurahashi discloses a wooden golf club head body reinforced by a mixture of wood-plastic composite material. The wood-plastic composite material being unevenly distributed such that a higher density in the range of between 5 and 15 mm lies adjacent to and extends substantially parallel with the front face of the club head.

U.S. Pat. No. 4,021,047 to Mader discloses a golf club wherein the sole plate, face plate, heel, toe and hosel portions are formed as a unitary cast metal piece and wherein a wood or composite crown is attached to this unitary piece thereby forming hollow chamber in the club head.

U.S. Pat. No. 5,624,331 to Lo, et al. discloses a hollow metal golf club head where the metal casing of the head is composed of at least two openings. The head also contains a composite material disposed within the head where a portion of the composite material is located in the openings of the golf club head casing.

U.S. Pat. No. 1,167,387 to Daniel discloses a hollow golf club head wherein the shell body is comprised of metal such as aluminum alloy and the face plate is comprised of a hard wood such as beech, persimmon or the like. The face plate is aligned such that the wood grain presents endwise at the striking plate.

U.S. Pat. No. 3,692,306 to Glover discloses a golf club head having a bracket with sole and striking plates formed integrally thereon. At least one of the plates has an embedded elongate tube for securing a removably adjustable weight means.

U.S. Pat. No. 5,410,798 to Lo discloses a method of manufacturing a composite golf club head using a metal casing to which a laminated member is inserted. A sheet of composite material is subsequently layered over the openings of the laminated member and metal casing to close off the openings in the top of both. An expansible pocket is then inserted into the hollow laminated member comprising sodium nitrite, ammonium chloride and water causing the member to attach integrally to the metal casing when the head is placed into a mold and heated.

U.S. Pat. No. 4,877,249 to Thompson discloses a wood golf club head embodying a laminated upper surface and metallic sole surface having a keel. In order to reinforce the laminations and to keep the body from delaminating upon impact with an unusually hard object, a bolt is inserted through the crown of the club head where it is connected to the sole plate at the keel and tightened to compress the laminations.

U.S. Pat. No. 3,897,066 to Belmont discloses a wooden golf club head having removably inserted weight adjustment members. The members are parallel to a central vertical axis running from the face section to the rear section of the club head and perpendicular to the crown to toe axis. The weight adjustment members may be held in place by the use of capsules filled with polyurethane resin, which can also be used to form the faceplate. The capsules have openings on a rear surface of the club head with covers to provide access to adjust the weight means.

U.S. Pat. No. 2,750,194 to Clark discloses a wooden golf club head with weight adjustment means. The golf club head includes a tray member with sides and bottom for holding the weight adjustment preferably cast or formed integrally with the heel plate. The heel plate with attached weight member is inserted into the head of the golf club via an opening.

U.S. Pat. No. 5,193,811 to Okumoto, et al. discloses a wood type club head body comprised primarily of a synthetic resin and a metallic sole plate. The metallic sole plate has on its surface for bonding with the head body integrally formed members comprising a hosel on the heel side, weights on the toe and rear sides and a beam connecting the weights and hosel. Additionally, U.S. Pat. No. 5,516,107 to Okumoto, et al. discloses a golf club head having an outer shell, preferably comprised of synthetic resin, and metal weight member/s located on the interior of the club head. A foamable material is injected into the hollow interior of the club to form the core. Once the foamable material has been injected and the sole plate is attached, the club head is heated to cause the foamable material to expand thus holding the weight member/s in position in recess/es located in toe, heel and/or back side regions by pushing the weight member into the inner surface of the outer shell.

U.S. Pat. No. 4,872,685 to Sun discloses a wood type golf club head wherein a female unit is mated with a male unit to form a unitary golf club head. The female unit comprises the upper portion of the golf club head and is preferably composed of plastic, alloy, or wood. The male unit includes the structural portions of sole plate, a face insert consists of the striking plate and weighting elements. The male unit has a substantially greater weight being preferably composed of a light metal alloy. The units are mated or held together by bonding and or mechanical means.

U.S. Pat. No. 5,398,935 to Katayama discloses a wood golf club head having a striking face wherein the height of the striking face at a toe end of the golf club head is nearly equal to or greater than the height of the striking face at the center of the club head.

U.S. Pat. No. 1,780,625 to Mattern discloses a club head with a rear portion composed of a light-weight metal such as magnesium. U.S. Pat. No. 1,638,916 to Butchart discloses a golf club with a balancing member composed of persimmon or a similar wood material, and a shell-like body composed of aluminum attached to the balancing member.

SUMMARY OF INVENTION

The present invention is a putter-type golf club head having a body composed of a metal material and a crown portion composed of a non-metallic material. The body has a sole wall, a ribbon wall and a front wall which define an internal cavity. The body also has a heel mass and a toe mass formed integrally within an interior of the body. The crown portion is preferably composed of a composite material such as plies of pre-preg material and a bulk molding compound. The crown portion is attached to the body to cover the internal cavity of the major body, and thus form a hollow interior.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
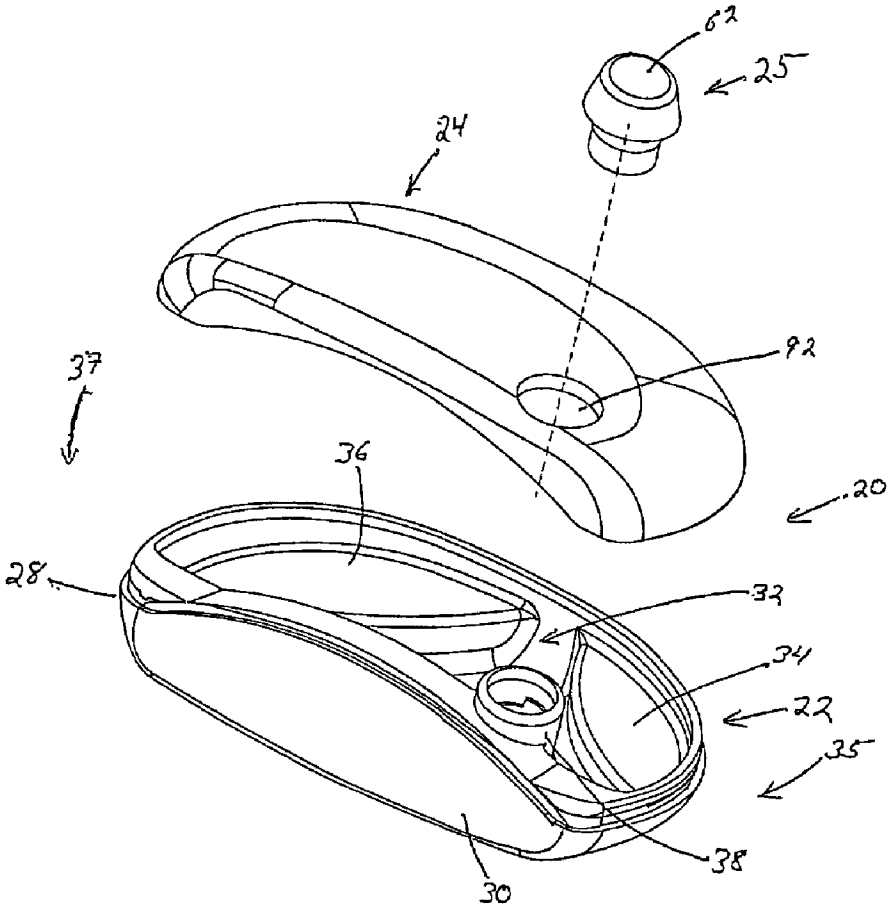
FIG. 1 is an exploded view of a putter head of the present invention.
Figure 2:
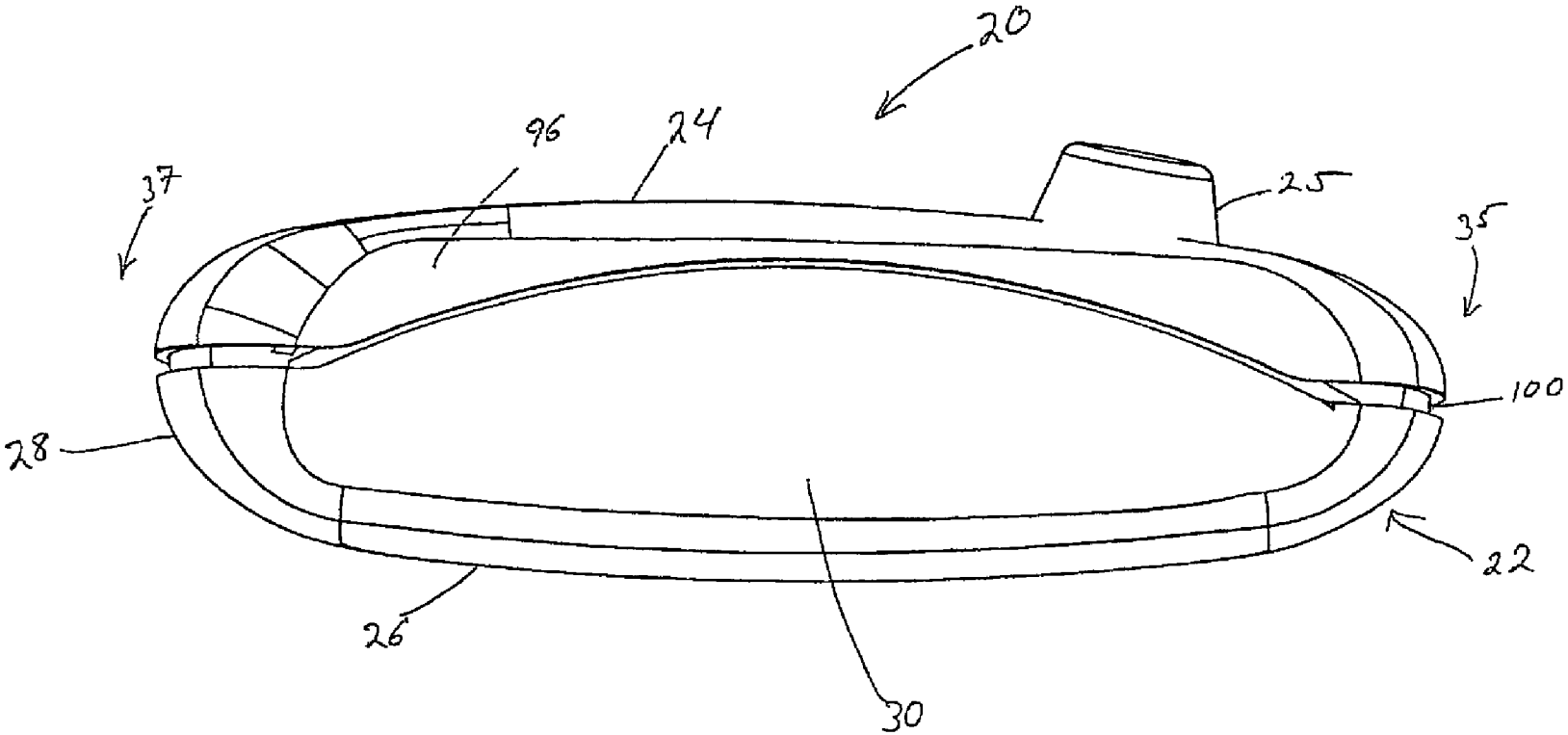
FIG. 2 is a front view of a putter head of the present invention.
Figure 3:
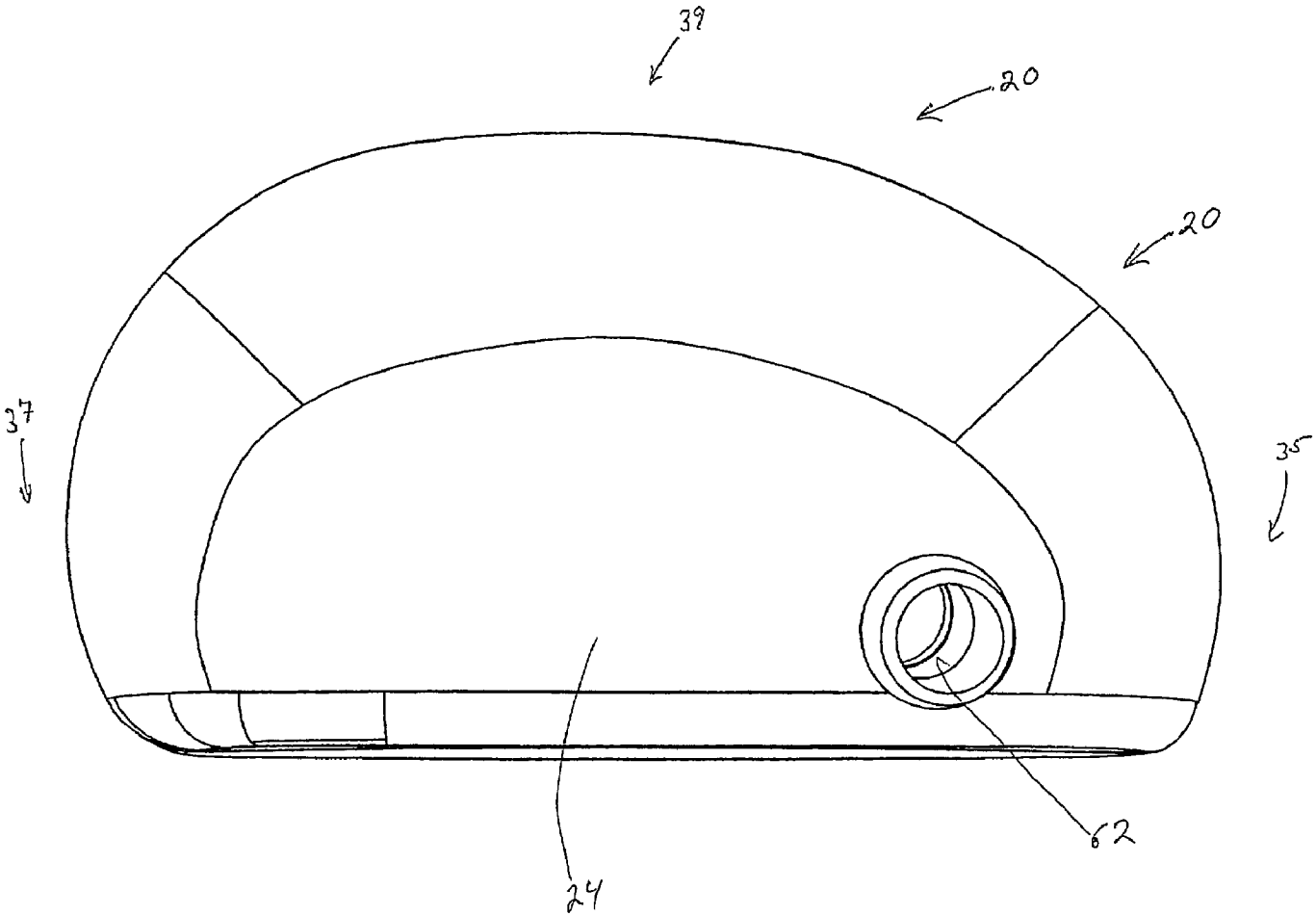
FIG. 3 is top view of a putter head of the present invention.
Figure 4:
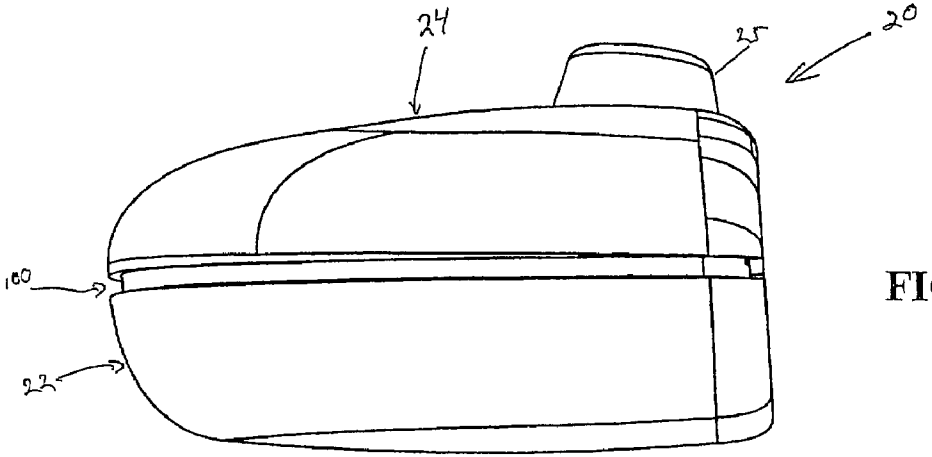
FIG. 4 is a toe side plan view of a putter head of the present invention.
Figure 5:
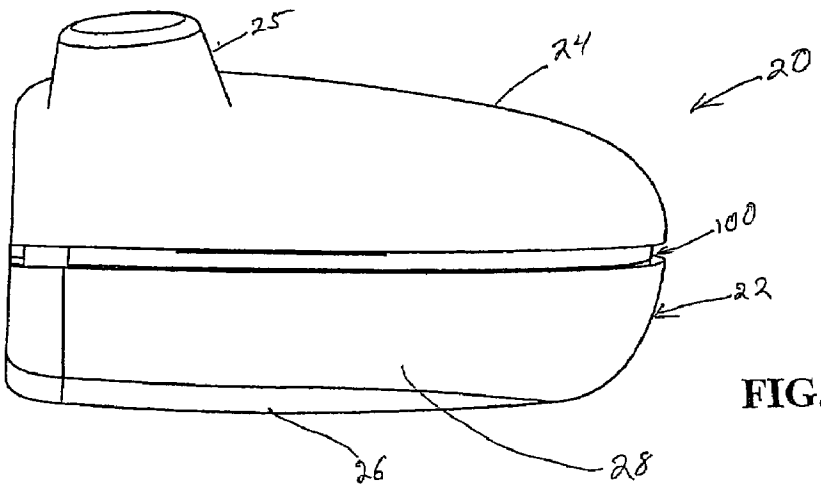
FIG. 5 is a heel side plan view of a putter head of the present invention.
Figure 6:
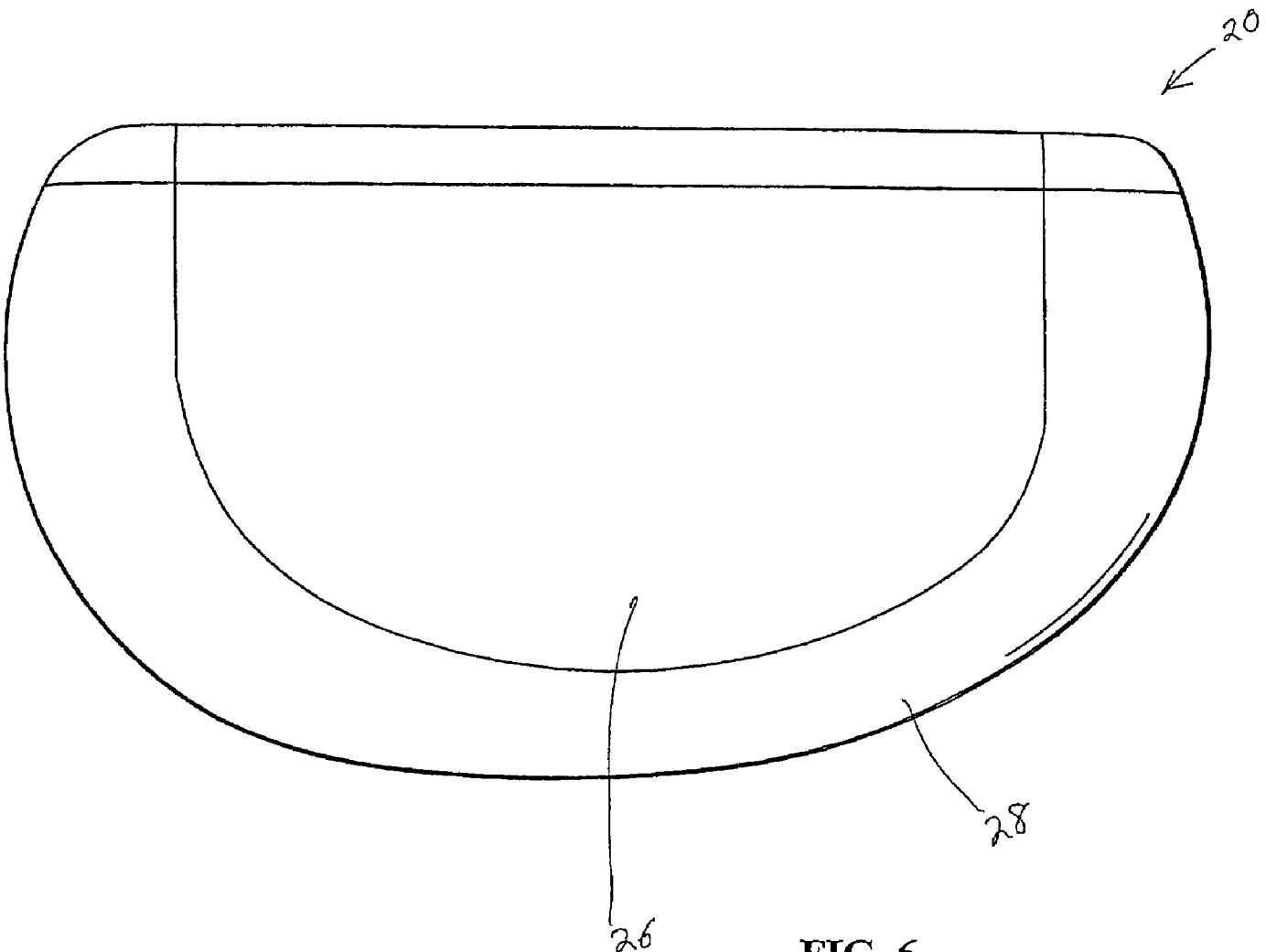
FIG. 6 is a bottom plan view of a putter head of the present invention.
Figure 7:
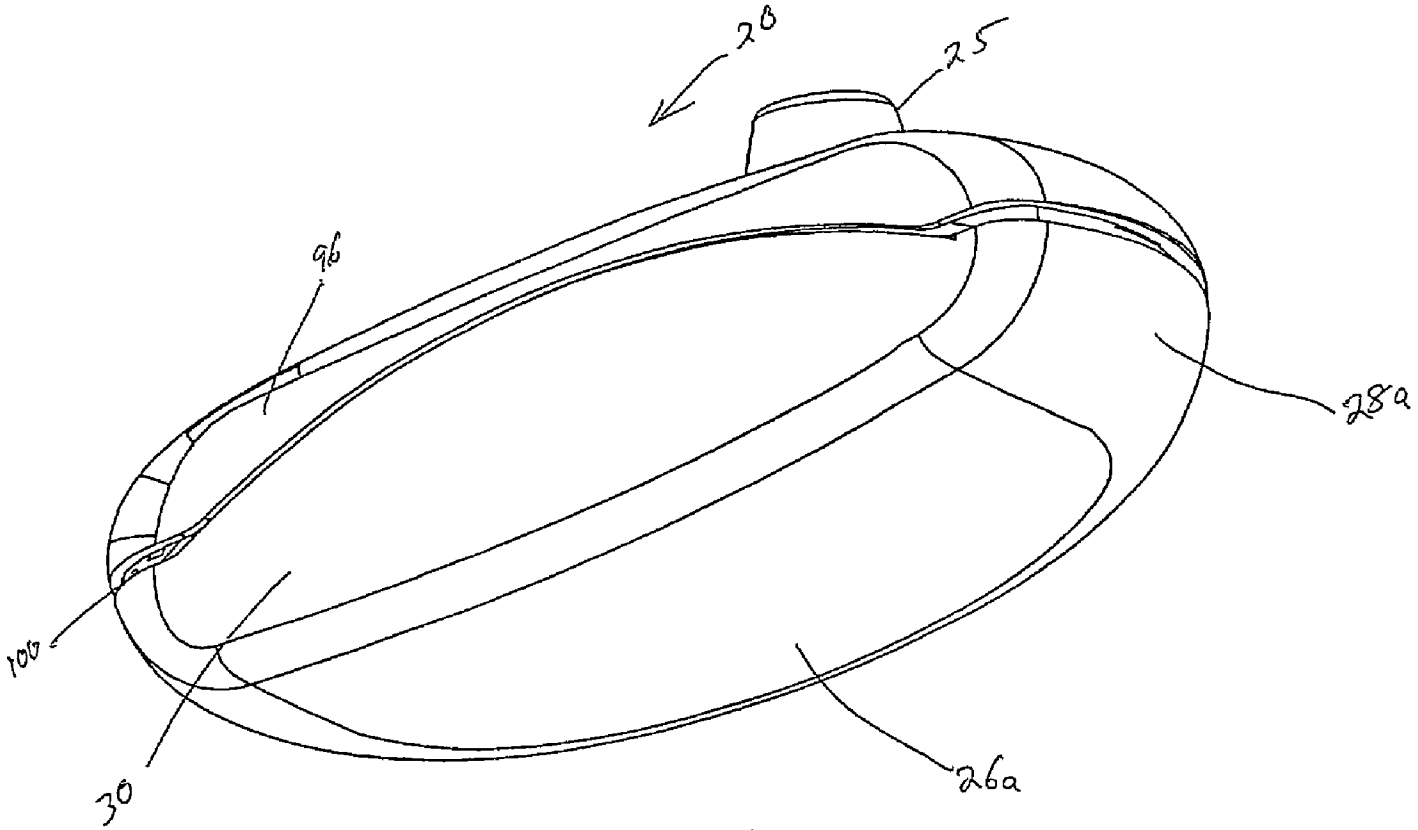
FIG. 7 is a bottom perspective view of a putter head of the present invention.
Figure 8:
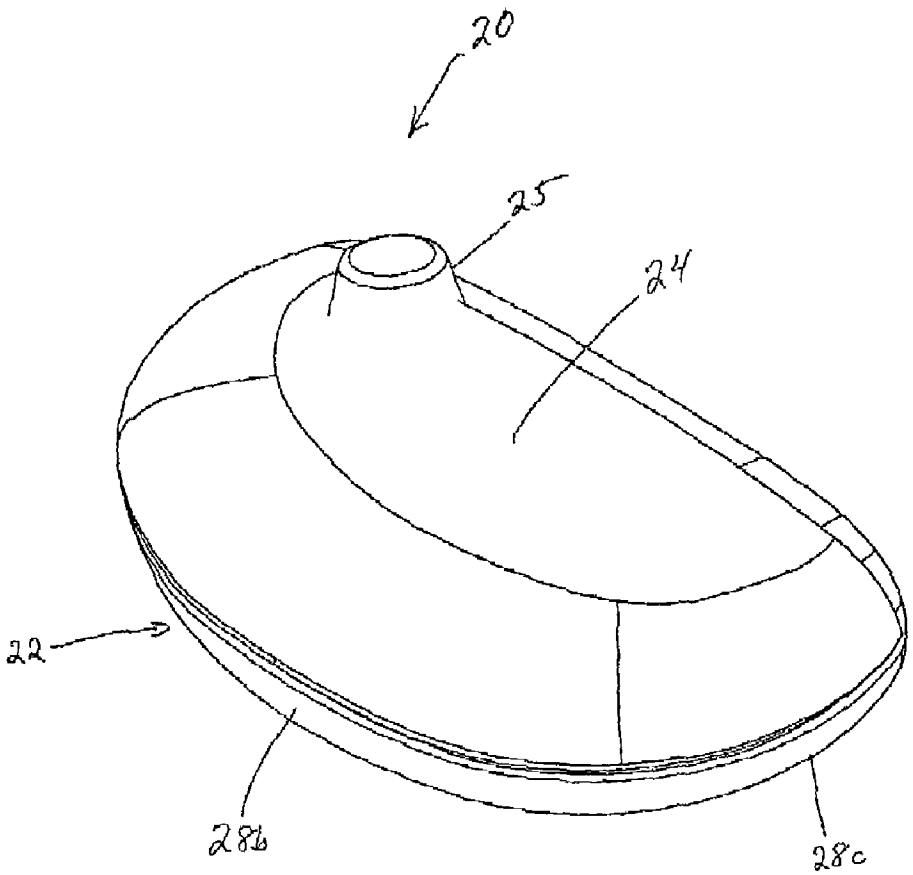
FIG. 8 is a rear perspective view of a putter head of the present invention.
Figure 9:
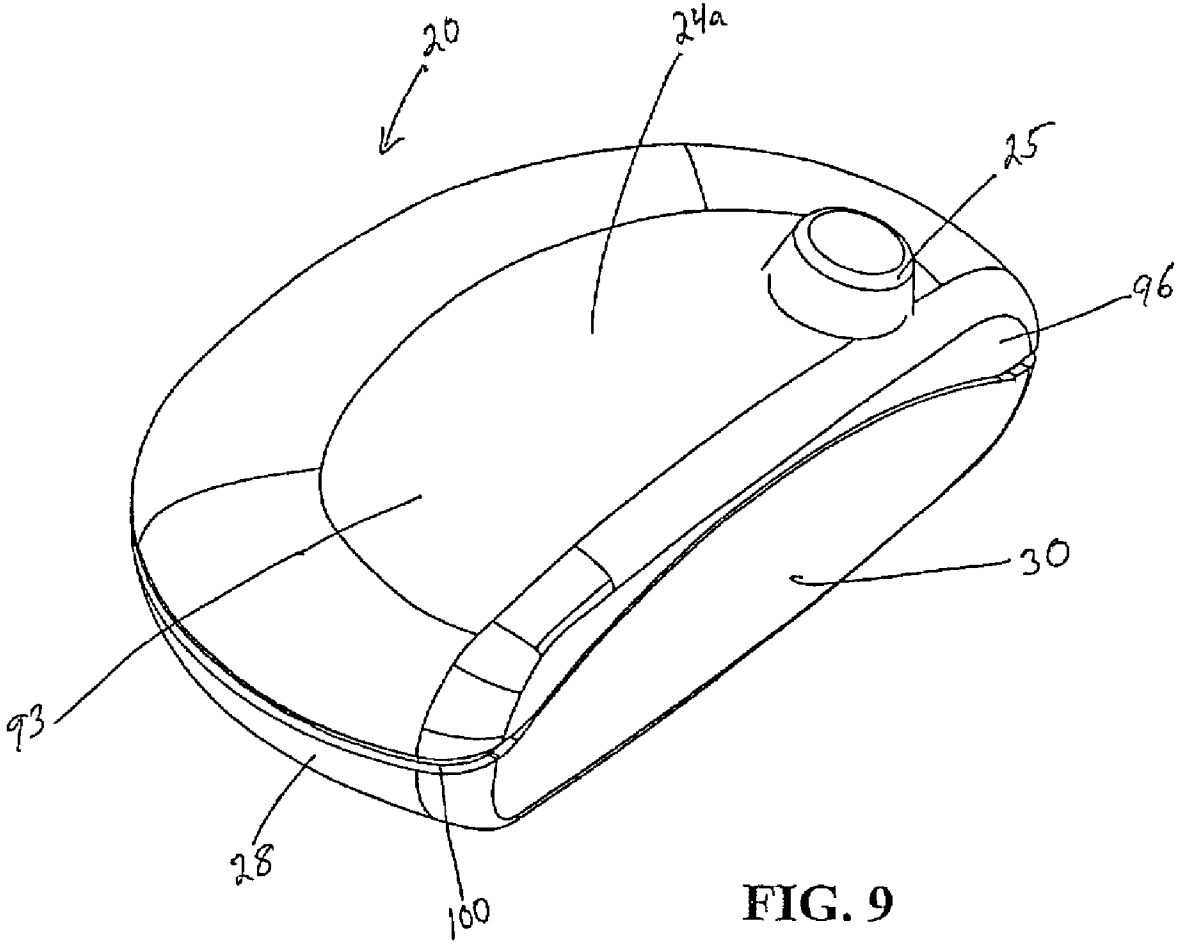
FIG. 9 is top perspective view of a putter head of the present invention.

As shown in FIGS. 1–9, a putter head is generally designated 20. The putter head 20 is generally composed of two components, a body 22 and a crown portion 24.

The body 22 is generally composed of a single piece of metal, and is preferably composed of a cast metal material. More preferably, the cast metal material is a stainless steel material or a titanium material such as pure titanium and titanium alloys such as 6-22-22 titanium alloy available from RMI, 6-4 titanium alloy, SP-700 titanium alloy available from Nippon Steel of Tokyo, Japan, DAT 55G titanium alloy available from Diado Steel of Tokyo, Japan, Ti 10-2-3 Beta-C titanium alloy available from RTI International Metals of Ohio, and the like. Alternatively, the body 22 is manufactured through forging, welding, forming, machining, powdered metal forming, metal-injection-molding, electro-chemical milling, and the like.

As shown in FIGS. 13–18, the body 22 is generally composed of a sole wall 26, a ribbon wall 28 and a front wall 30. The body 22 also has a heel mass 34 at a heel end 35 of the body 22 and a toe mass 36 at a toe end 37 of the body 22. Both masses 34 and 36 are positioned within the interior of the body 22. An internal cavity 32 of the body 22 is defined by the sole wall 26, the ribbon wall 28, the front wall 30, the heel mass 34 and the toe mass 36. The body 22 preferably has an internal tube 38 for receiving a hosel insert 25 and/or shaft, not shown.

The ribbon wall 28 is partitioned into a heel ribbon 28*a* at the heel end 35 of the body 22, an aft ribbon wall 28*b* at the aft end 39 of the body, and a toe ribbon wall 28*c* at the toe end 37 of the body 22. The ribbon wall 28 preferably has a thickness that ranges from 0.03 inch to 0.30 inch, and more preferably ranges from 0.05 inch to 0.150 inch.

At the upper end of the ribbon wall 28 is a perimeter ledge 50, which defines the upper limit of the ribbon wall 28. The perimeter ledge 50 has a width that preferably ranges from 0.05 inch to 0.25 inch. An upper ribbon wall 70 begins at the inward limit of the perimeter ledge 50, and the upper ribbon wall 70 extends preferably perpendicular to the perimeter ledge 50. At the upper limit of the upper ribbon wall 70 is an interior edge 52 which is preferably parallel to the perimeter edge 50 along the extent of the upper ribbon wall 70. The interior ledge 52 has a width that preferably ranges from 0.05 inch to 0.25 inch.

The toe ribbon wall 28*c* and the heel ribbon wall 28*a* merge into the front wall 30. The front wall 30 has a striking surface 30*a* and an interior surface 30*b*. The front wall 30 preferably has a thickness that ranges from 0.05 inch to 0.50 inch, and more preferably ranges from 0.125 inch to 0.200 inch. The front wall 30 preferably has a convex curvature relative to the sole wall 26, and the front wall 30 is preferably perpendicular to the sole wall 26. The convex curvature of the front wall 30 has an apex 30*c* about the center line of the body 22. The radius of the convex curvature of the front wall 30 is preferably constant from the heel end 35 of the front wall 30 to the toe end 37 of the front wall 30. Preferably, the apex 30*c* of the front wall 30 is slightly greater in height than the interior edge 52.

The interior tube 38 for receiving a shaft, not shown, and a portion of the hosel insert 25 are located within the interior of the body 22, nearer the heel end 35 of the body 22. The interior tube 38 is defined by a cylindrical wall 60, which projects upwards from the interior surface 26*a* of the sole wall 26. The cylindrical wall 60 defines a bore 62, which preferably terminates at the sole wall 26. The bore 62 has a diameter sized to receive a shaft, not shown, and the hosel insert 25. The interior 38 is preferably cast with the body 22, however those skilled in the pertinent art will recognize that the interior tube 38 may also be a separate component that is welded to the body 22 without departing from the scope and spirit of the present invention.

The crown portion 24 is preferably composed of a non-metal material, preferably a composite material such as continuous fiber pre-preg material (either thermosetting resin or thermoplastic resin) over a bulk molding compound. Most preferably, the crown portion is composed of a twill pre-preg woven fabric material over a carbon bulk molding compound. Such bulk molding compounds include MS-4A carbon fiber and epoxy molding system from YLA, Inc., of Benicia Calif., LYTEX 4181 and LYTEX 4149 carbon fiber epoxy molding compounds from Quantum Composites of Bay City Mich., ENDURON compound from Cytec Fiberite, and other similar bulk molding compounds. One preferred method for making a crown portion 24 includes creating a preform of the crown portion 24 composed of twill pre-preg woven fabric material and a preform of the crown portion 24 composed of a bulk molding compound, and then compression molding the two preforms (the twill pre-preg woven fabric preform over the bulk molding compound preform) to create the crown portion 24. Other materials for the crown portion 24 include other thermosetting materials or other thermoplastic materials such as injection molded plastics. The crown portion 24 is preferably manufactured through compression molding a continuous carbon fiber pre-preg material. Alternative methods for manufacturing the crown portion 24 include bladder-molding, resin transfer molding, resin infusion or injection molding.

Figure 10:
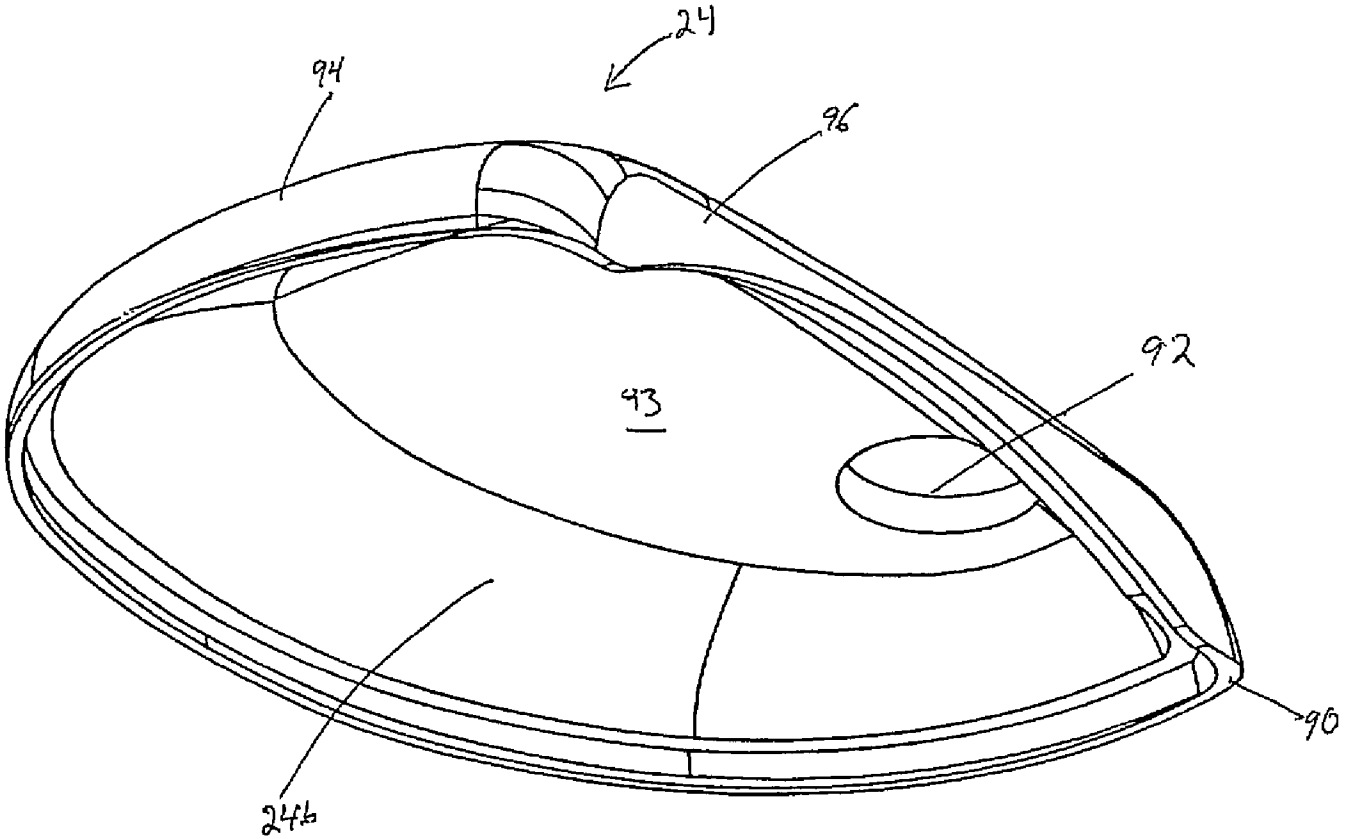
FIG. 10 is an isolated bottom perspective view of the crown portion of a putter head of the present invention.
Figure 11:
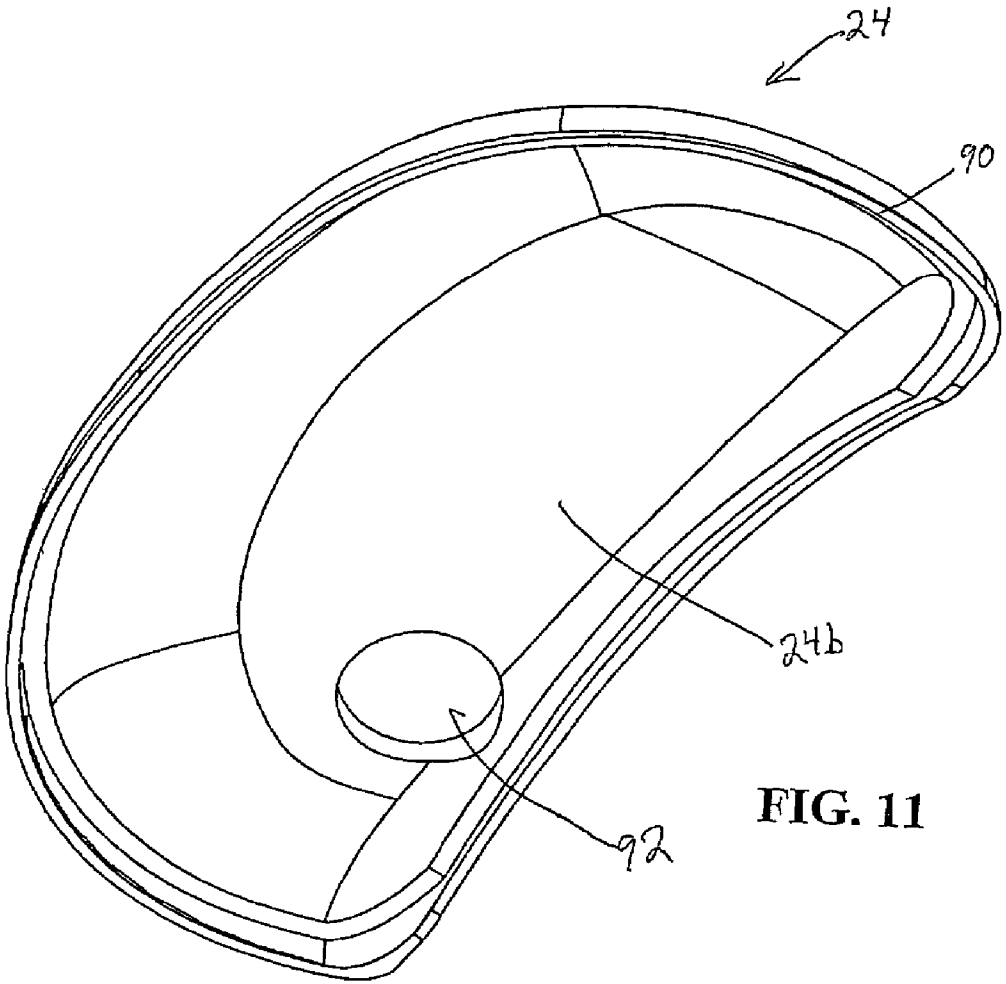
FIG. 11 is an isolated bottom view of the crown portion of a putter head of the present invention.

As shown in FIGS. 10 and 11, the crown portion 24 has a crown top wall 93, a crown side wall 94 and a crown front wall 96. The crown portion 24 has an inner surface 24*b* and an external surface 24*a*. The crown front wall 96 has a concave curvature that corresponds to the convex curvature of the front wall 30. The crown portion 24 also has a crown perimeter 90 that defines its lower limit. The thickness of the crown perimeter 90 preferably corresponds to the thickness of the perimeter ledge 50 of the body 22. The crown portion 24 also has a bore 92 for receiving the shaft, not shown and the hosel insert 25.

Figure 12:
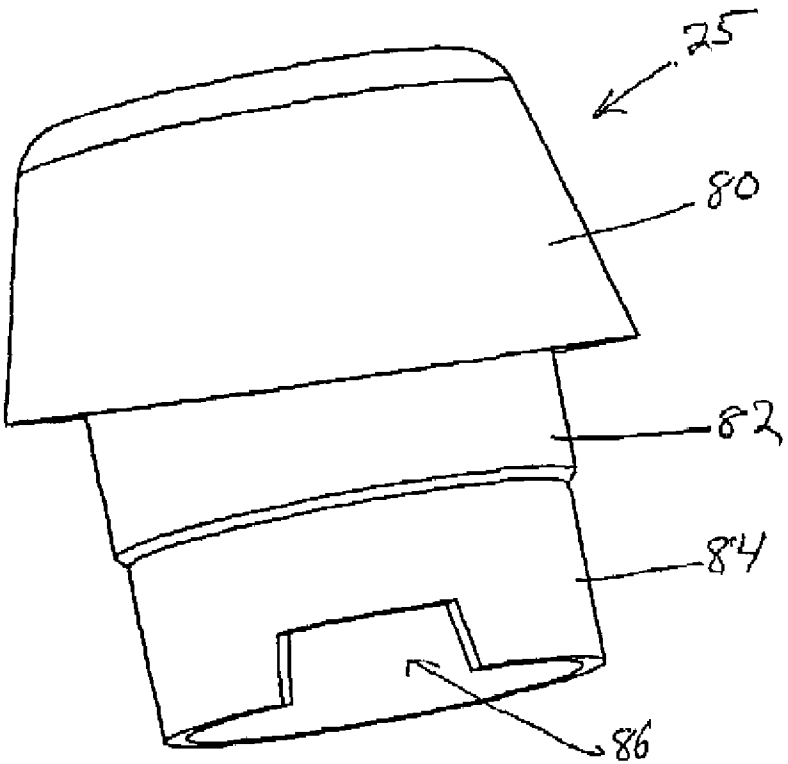
FIG. 12 is an isolated view of a hosel insert.
Figure 13:
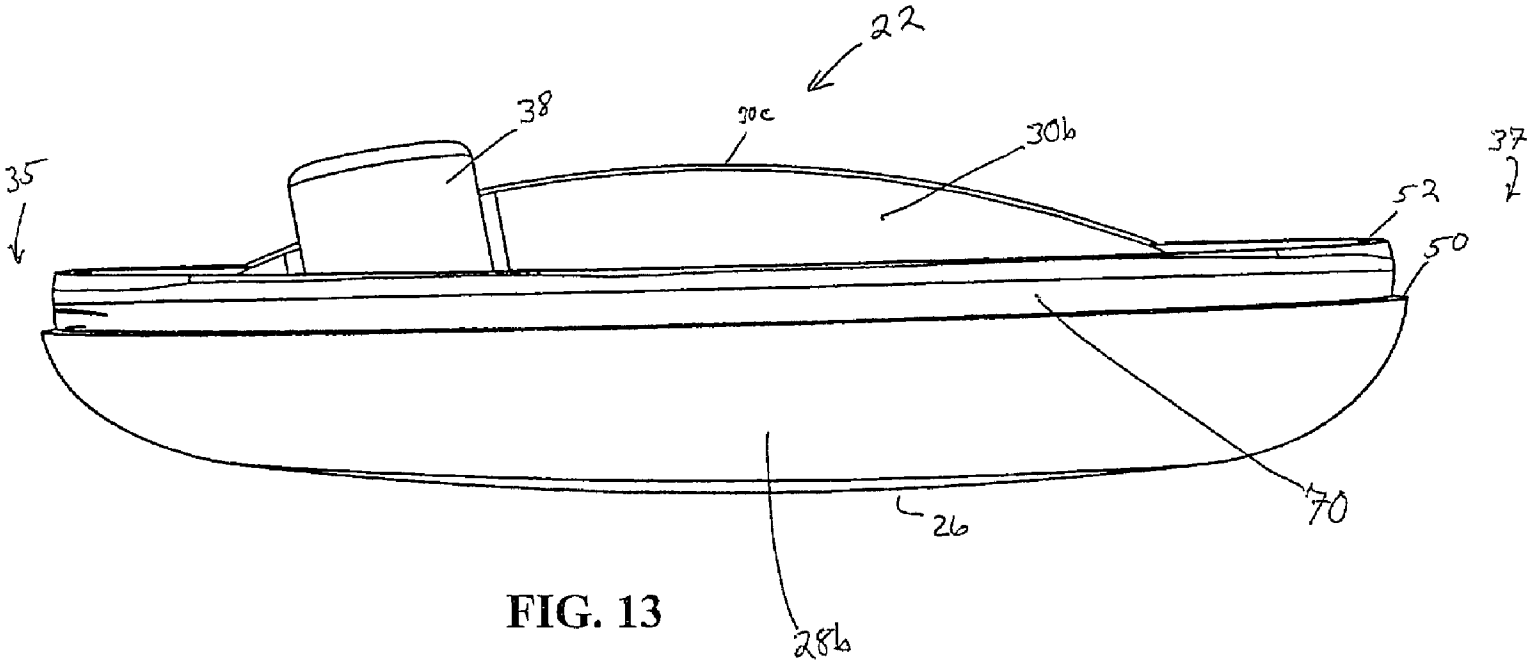
FIG. 13 is an isolated rear view of the body portion of a putter head of the present invention.
Figure 14:
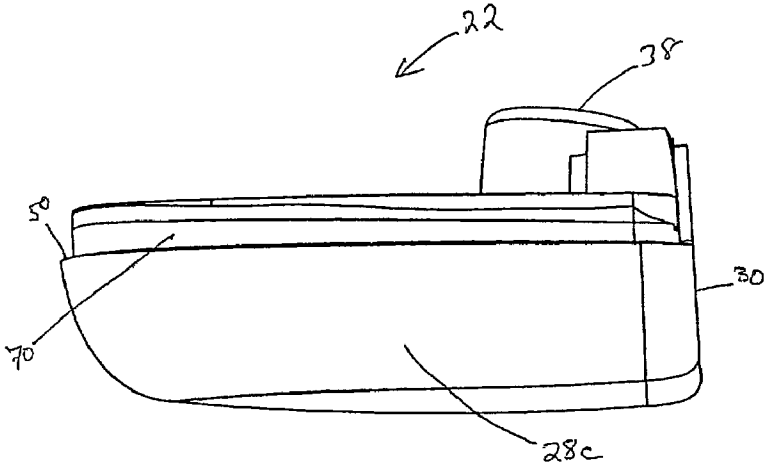
FIG. 14 is an isolated toe view of the body portion of a putter head of the present invention.
Figure 15:
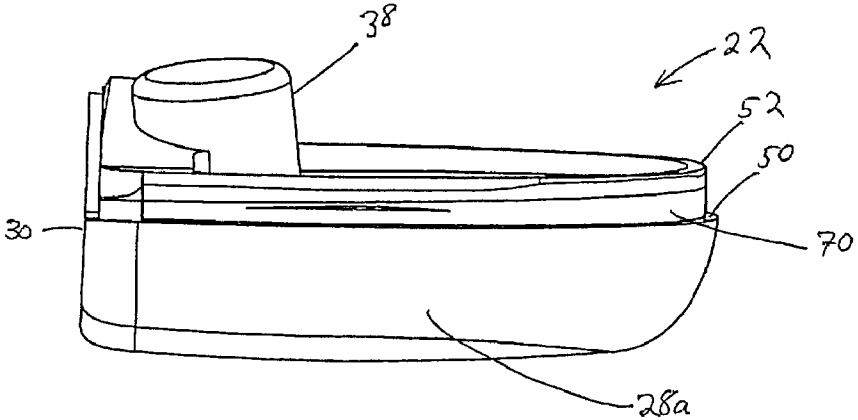
FIG. 15 is an isolated heel view of the body portion of a putter head of the present invention.
Figure 16:
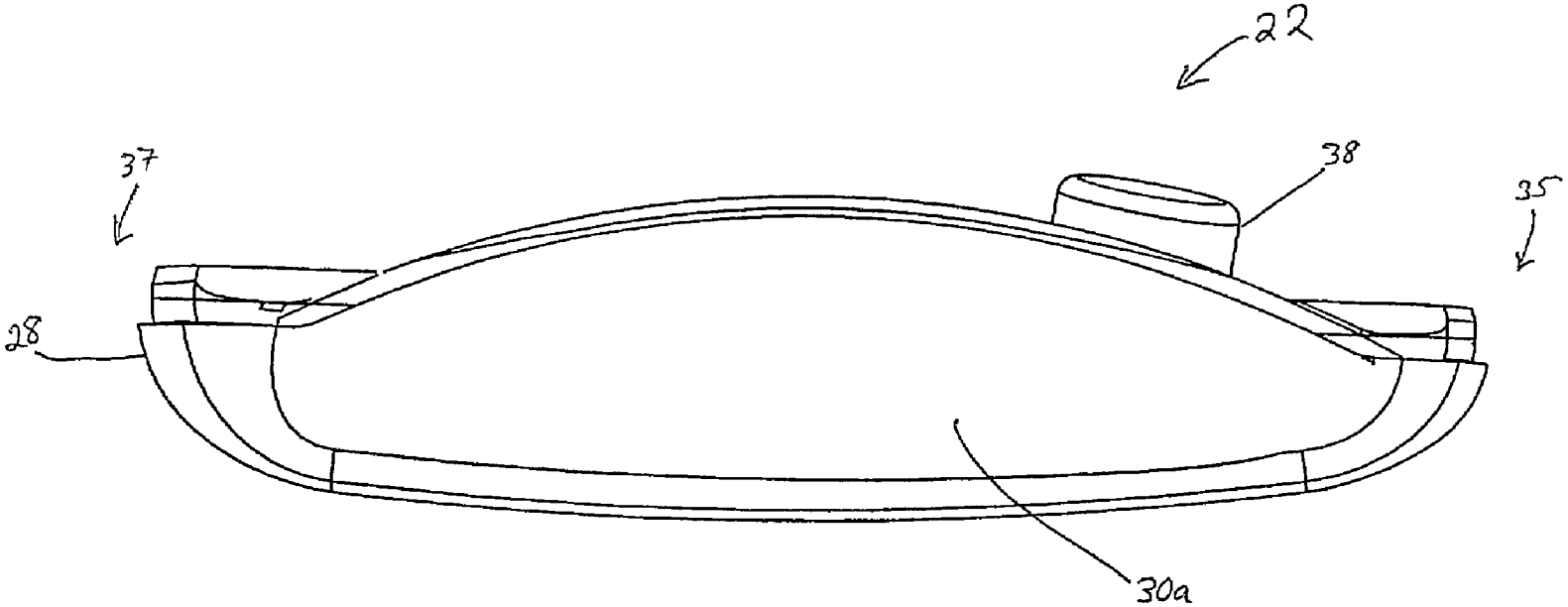
FIG. 16 is an isolated front view of the body portion of a putter head of the present invention.
Figure 17:
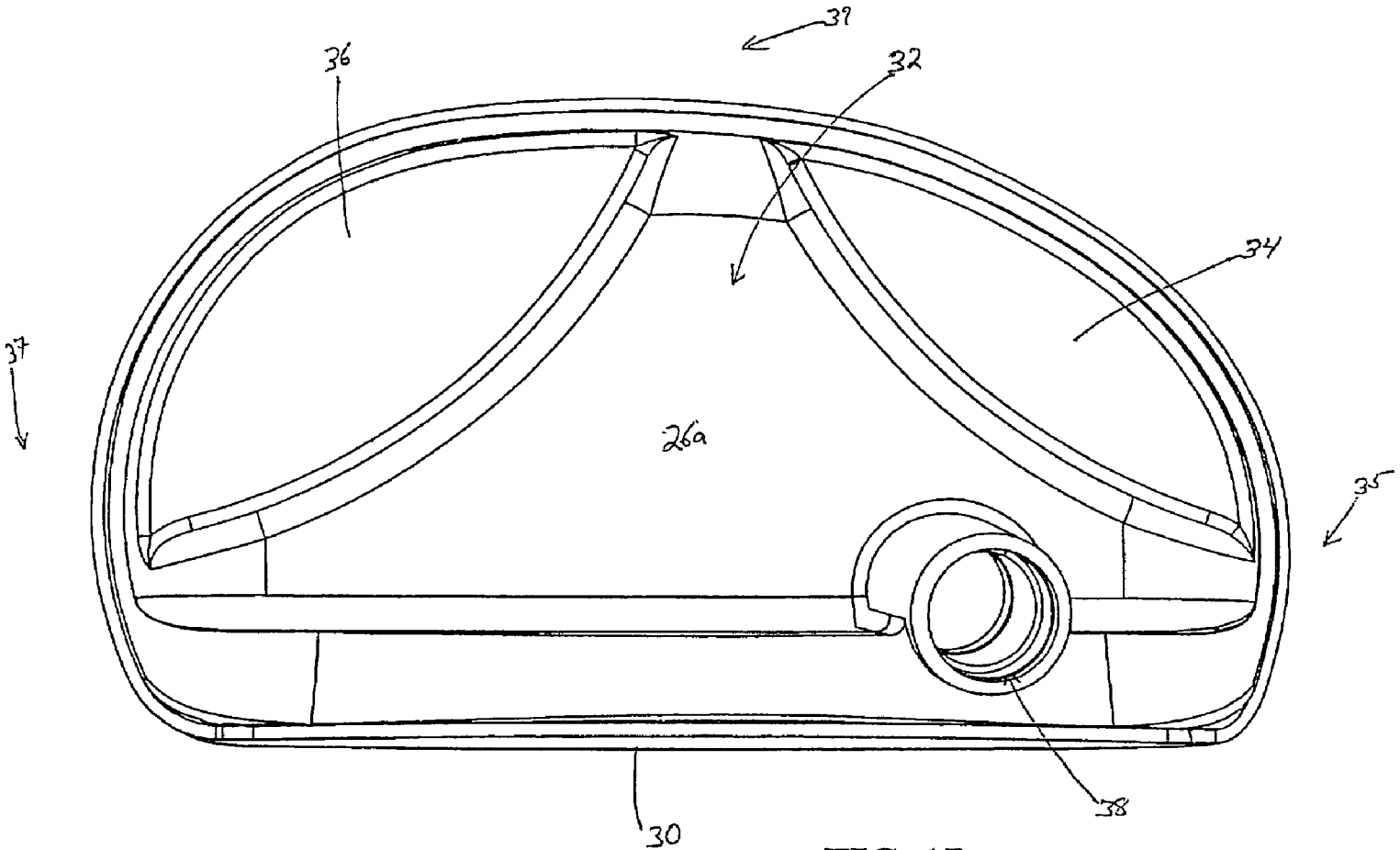
FIG. 17 is an isolated top plan view of the body portion of a putter head of the present invention.
Figure 18:
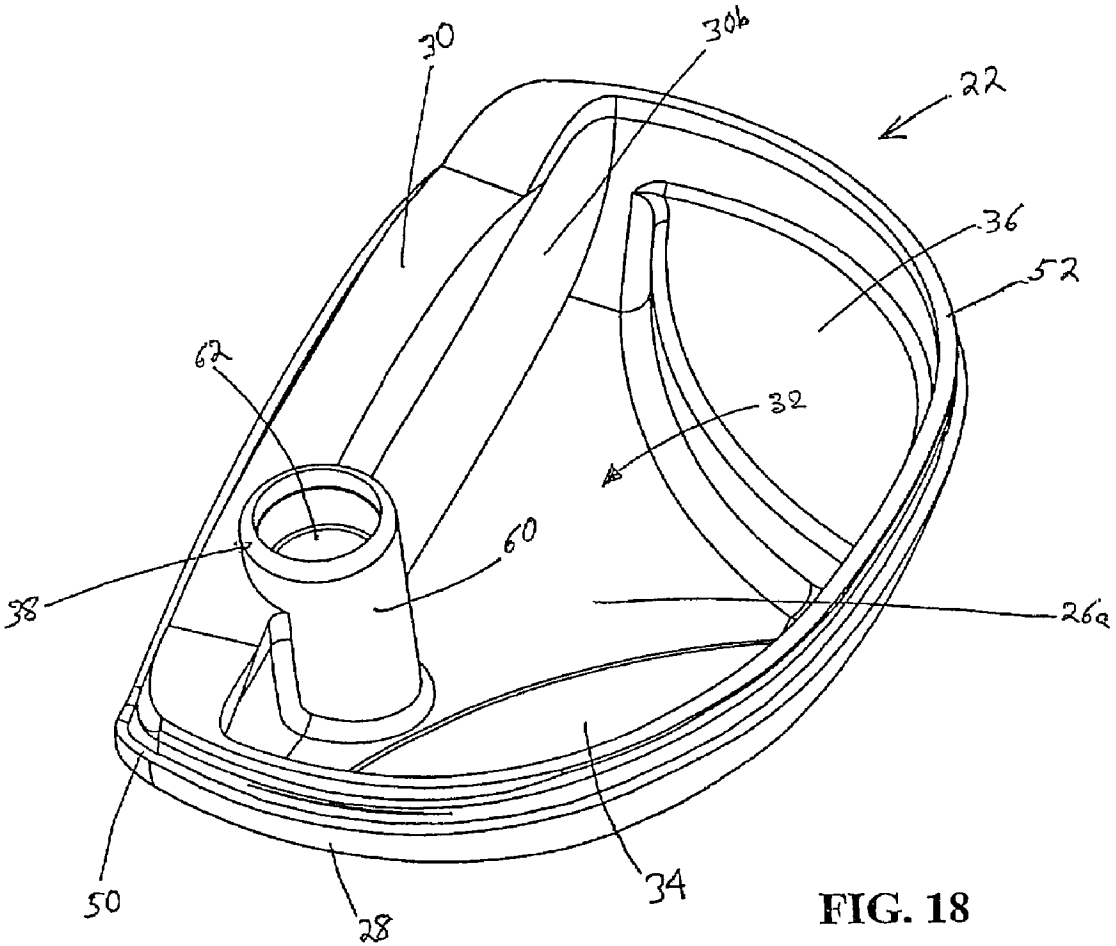
FIG. 18 is an isolated top perspective view of the body portion of the putter head of the present invention.

As shown in the FIG. 12, the hosel insert 25 preferably includes a tapered top 80, a center body 82, and a bottom body 84 with a notch 86. The notch 86 allows for the hosel insert 25 to be fixed in position in the interior tube 38. In an alternative embodiment, the hosel insert 25 does not have a notch 86. The hosel insert 25 is preferably composed of a polyurethane material, and preferably has a mass ranging from 0.5 gram to 2.0 grams, and more preferably from 0.75 gram to 1.5 grams.

In a preferred process, the body 22, with an adhesive on the exterior surface of the interior ledge 52 is press-fitted with the crown portion 24. Such adhesives include thermosetting adhesives in a liquid or a film medium. A preferred adhesive is a two part liquid epoxy sold by 3M of Minneapolis, Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention.

In a preferred embodiment, the crown portion 24 is composed of a bulk molding compound and a plurality of plies of pre-preg, typically two to seven plies, such as disclosed in U.S. Pat. No. 6,248,025, entitled Composite Golf Head And Method Of Manufacturing, which is hereby incorporated by reference in its entirety.

The mass of the putter head 20 preferably ranges from 200 grams to 400 grams, more preferably from 275 grams to 370 grams, and most preferably from 300 grams to 350 grams, with a most preferred mass of 330 grams. Preferably, the body 22 has a mass ranging from 180 grams to 380 grams, more preferably from 250 grams to 350 grams, yet more preferably from 275 grams to 320 grams, and most preferably 300 grams. The crown portion 24 has a mass preferably ranging from 10 grams to 30 grams, more preferably from 20 grams to 25 grams, and most preferably 24 grams.

The center of gravity and the moment of inertia of a golf club head 20 are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in co-pending U.S. patent application Ser. No. 09/796,951, filed on Feb. 27, 2001, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z axis for the putter head 20 ranges from 2800 g-cm$^2$ to 5000 g-cm$^2$, preferably from 3000 g-cm$^2$ to 4500 g-cm $^2$, even more preferably from 3200 g-cm$^2$ to 4000 g-cm$^2$, and most preferably 3758 g-cm$^2$. The moment of inertia, Iyy, about the Y axis for the putter head 20 ranges from 1500 g-cm$^2$ to 4000 g-cm$^2$, preferably from 2500 g-cm$^2$ to 3400 g-cm $^2$, even preferably from 2900 g-cm$^2$ to 3100 g-cm$^2$, and most preferably 3003 g-cm $^2$.

Further, the putter head 20 preferably has low products of inertia such as disclosed in U.S. Pat. No. 6,425,832, which was filed on Jul. 26, 2001 and is hereby incorporated by reference in its entirety. The product of inertia Ixy of the putter head 20 preferably has an absolute value less than 100 g-cm$^2$. Preferably, the product of inertia Ixy is less than 50 g-cm$^2$, and most preferably the product of inertia Ixy approaches zero. The product of inertia Ixz of the putter head 20 has an absolute value less than 100 g-cm$^2$. Preferably, the product of inertia Ixz is less than 50 g-cm$^2$, and most preferably the product of inertia Ixz approaches zero. The product of inertia Iyz of the putter head 20 preferably has an absolute value less than 100 g-cm$^2$. Preferably, the product of inertia Iyz is less than 50 g-cm$^2$, and most preferably the product of inertia Iyz approaches zero.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A putter-type golf club head comprising:

a body composed of cast stainless steel, the body having a front wall, a bottom wall, a ribbon wall and a ledge, the front wall having a thickness in the range of 0.010 inch to 0.250 inch, the ledge extending inward a distance ranging from 0.05 inch to 0.25 inch from an exterior surface of the body, and the front wall, the bottom wall and the ribbon wall defining an internal cavity, the body having a heel mass and a toe mass; and a crown portion composed of plies of pre-preg material over a bulk molding compound, the crown portion having a top wall, a side wall and a front wall, the crown portion attached to the ledge of the body, wherein the golf club head has a moment of inertia about an Izz axis of the golf club head that ranges from 2800 grams-centimeter squared to 5000 grams-centimeter squared.

* * * * *